US005363927A

United States Patent [19]

Frank

[11] Patent Number: 5,363,927

[45] Date of Patent: Nov. 15, 1994

[54] APPARATUS AND METHOD FOR HYDRAULIC DRILLING

[76] Inventor: Robert C. Frank, 4705 Caspian St., Farmington, N. Mex. 87402

[21] Appl. No.: 127,690

[22] Filed: Sep. 27, 1993

[51] Int. Cl.[5] ..... E21B 7/18; E21B 10/60

[52] U.S. Cl. ..... 175/67; 166/223; 175/231; 175/232; 175/393; 175/324; 175/424; 299/17

[58] Field of Search ..... 175/67, 424, 393, 231, 175/232, 324; 166/222, 223; 299/17

[56] References Cited

U.S. PATENT DOCUMENTS

| | | | |
|---|---|---|---|
| 1,401,464 | 12/1921 | Crotto | 166/223 |
| 1,427,944 | 9/1922 | Crotto | 166/223 |
| 2,018,285 | 10/1935 | Schweitzer et al. | 166/223 X |
| 2,218,130 | 10/1940 | Court | 15/104.12 |
| 2,720,381 | 10/1955 | Quick | 255/1.8 |
| 3,189,107 | 6/1965 | Galle | 175/393 |
| 3,326,607 | 6/1967 | Book | 299/58 |
| 3,528,704 | 9/1970 | Johnson, Jr. | 299/14 |
| 3,547,191 | 12/1970 | Malott | 166/223 |
| 3,881,775 | 5/1975 | McPherson et al. | 299/17 X |
| 3,960,407 | 6/1976 | Noren | 299/17 |
| 4,050,529 | 9/1977 | Tagirov et al. | 175/422 |
| 4,187,921 | 2/1980 | Garner | 175/340 |
| 4,497,664 | 2/1985 | Verry | 134/22.12 |
| 4,610,321 | 9/1986 | Whaling | 175/422 R |
| 4,687,066 | 8/1987 | Evans | 175/340 |
| 4,736,805 | 4/1988 | Shook et al. | 173/78 |
| 4,798,339 | 1/1989 | Sugino et al. | 239/601 |
| 4,852,668 | 8/1989 | Dickinson, III et al. | 175/67 |
| 4,930,586 | 6/1990 | Turin et al. | 175/25 |
| 4,960,176 | 10/1990 | Loegel et al. | 175/424 |
| 4,991,667 | 2/1991 | Wilkes, Jr. et al. | 175/61 |
| 5,253,718 | 10/1993 | Lawler | 175/424 X |

FOREIGN PATENT DOCUMENTS

| | | | |
|---|---|---|---|
| 1063012 | 9/1979 | Canada | 166/223 |
| 488001 | 1/1976 | Russian Federation | 166/222 |

*Primary Examiner*—Hoang C. Dang
*Attorney, Agent, or Firm*—Donovan F. Duggan; Deborah A. Peacock; Jeffrey D. Myers

[57] ABSTRACT

A process and apparatus for high pressure drilling are disclosed. The apparatus comprises an essentially solid drill head with horizontally extendable nozzle arms hingedly connected by shear pins thereto. Flow of high pressure fluid both extends the nozzle arms and flows through the nozzle arms, thereby fracturing and shearing material surrounding the drill head. Cessation of fluid flow returns the arms to the vertical position.

17 Claims, 3 Drawing Sheets

APPARATUS AND METHOD FOR HYDRAULIC DRILLING

BACKGROUND OF THE INVENTION

1. Field of the Invention (Technical Field)

The invention relates to a drilling apparatus, more particularly to a hydraulic drilling apparatus; and a method for its use.

2. Background Art

Hydraulic drilling has long been known in the art. One method, the cavitation method, involves the production of bubbles within a liquid. The bubbles collapse upon or adjacent the surface of the material worked upon, thereby disintegrating such material. The bubbles (or cavities) may be produced by turbulence-inducing jet nozzles or by the shear effect, such as created by the vortices (cavities) produced when a high speed liquid jet penetrates relatively stagnant liquid.

U.S. Pat. No. 4,798,339, to Sugino, et. al., entitled *Submerged Jet Injection Nozzle*, discloses divergent nozzle structure for generating the cavitation phenomenon. Similarly, U.S. Pat. No. 3,528,704, to Johnson, Jr., entitled Process for *Drilling by a Cavitating Fluid Jet*, discloses convergent nozzle structure for utilizing the cavitation phenomenon for drilling. U.S. Pat. No. *4,610,321*, to Whaling, entitled *Cavitating Jet Device*, teaches a jet nozzle drilling bit wherein both nozzle shape and the shear phenomenon are used in producing cavitation. U.S. Pat. No. 4,497,664, to Verry, entitled *Erosion of a Solid Surface with a Cavitating Liquid Jet*, teaches cavitating nozzle structure employing deflectors for directing fluid radially outward from the nozzle.

Other drilling devices disclose the use of different hydraulic effects. U.S. Pat. No. 4,687,066, to Evans, entitled *Rock Bit Circulation Nozzle*, discloses a nozzle wherein a divergent vortex of drilling fluid is created to sweep away rock cuttings. U.S. Pat. No. *3,189,107*, to Galle, entitled *Flushing Passageway Closures with Reverse Pressure Rupturable Portion*, discloses a drill bit with nozzle plugs to prevent detritus from clogging the bit when lowered into the hole.

Among the most common drilling devices, however, are those that use the velocity and direction of high pressure fluid to drill and otherwise shear or break up underground rock. U.S. Pat. No. 4,991,667, to Wilkes, Jr., et. al., entitled *Hydraulic Drilling Apparatus and Method*, teaches selective application of drilling fluid to a plurality of inclined nozzles, thereby controlling the drilling direction. U.S. Pat. No. 4,736,805, to Shook, et. al., entitled *Hydraulic Breaker with High Pressure Water Attachment*, discloses an impact tool with high pressure fluid line attached, which combination expedites the rock breaking process. U.S. Pat. No. 3,960,407, to Noren, entitled *Cutters and Methods of Cutting*, teaches a rock spalling process using divergent high pressure fluid jets. U.S. Pat. No. 3,326,607, to Book, entitled *Apparatus for Disintegrating Materials by Means of Liquid Jets*, discloses a rotary device with radially extending passages, thereby using centrifugal force to impart additional velocity to the fluid jet.

Other high pressure hydraulic drilling devices include U.S. Pat. No. 2,218,130, to Court, entitled *Hydraulic Disruption of Solids*, which discloses a hydraulically-turned rotor mounting nozzles thereon, and a downwardly directed spear nozzle. U.S. Pat. No. 2,720,381, to Quick, entitled *Method and Apparatus for Hydraulic Reaming of Oil Wells*, likewise discloses a rotatable, horizontally directed hydraulic jet for removing debris from the well. U.S. Pat. No. 4,960,176, to Loegel, et. al., entitled *Device for Cutting, Drilling, or Similar Working of Rock, Ore, Concrete or the Like*, discloses a nozzle head having a plurality of nozzles therein. Various motions, such as oscillatory or rotary, can be executed by the nozzle head.

Additional high pressure hydraulic drilling devices include U.S. Pat. No. 4,852,668, to Dickinson, III, et. al., entitled *Hydraulic Drilling Apparatus and Method*. Dickinson, III, et. al., also disclose a rotatable drill head including a plurality of nozzles variably inclined to a vertical axis. U.S. Pat. No. 4,930,586, to Turin, et. al., entitled *Hydraulic Drilling Apparatus and Method*, discloses a hydraulic drill head wherein sensing and directional control of nozzles is provided by controlling fluid delivery to radially directed nozzles. U.S. Pat. No. 4,050,529, to Tagirov, et. al., entitled *Apparatus for Treating Rock Surrounding a Wellbore*, discloses reciprocating nozzles projecting radially from the housing for perforating casing and fracturing the formation with abrasive fluid.

Lacking in the prior art considered above, however, is a hydraulic drilling apparatus with horizontally extendable nozzle arms for circumferentially enlarging a drill hole by fracturing and shearing the surrounding rock with horizontally directed high pressure fluid.

SUMMARY OF THE INVENTION

Disclosure of the Invention

In accordance with the present invention, there is provided hydraulic drilling apparatus comprising means comprising a drill head having a longitudinal axis, means parallel to the longitudinal axis for channeling high pressure fluid through the drill head, and means diverting the high pressure fluid to and through a plurality of horizontally extendable nozzle arms, wherein the high pressure fluid horizontally extends the nozzle arms and flows through the nozzle arm.

The preferred embodiment of the present invention further comprises means for blocking high pressure fluid from flowing through the distal end of the drill head, and the high pressure fluid comprises a fluid selected from the group consisting of water, $N_2$, $CO_2$, drilling mud, sand, air, and mixtures thereof.

The preferred embodiment of the invention further comprises annular means for diverting high pressure fluid flow, and a spoonlike portion on each of the plurality of nozzle arms. Further, each of the plurality of nozzle arms comprises a converging-diverging nozzle, and at least one of the plurality of nozzle arms extends at an angle different from the remainder of the plurality of nozzle arms.

In the preferred embodiment of the invention, each of the nozzle arms comprises hinges connecting the nozzle arms to the drill head, and each of the hinges further comprises shear pins. The plurality of nozzle arms are returned to a position parallel to the longitudinal axis by gravity.

The preferred embodiment of the invention further comprises a method of hydraulic drilling comprising the steps of providing a drill head having a longitudinal axis, channeling high pressure fluid through a channel parallel to the longitudinal axis, and diverting the high pressure fluid to and through a plurality of nozzle arms, thereby extending the plurality of nozzle arms.

The preferred method of the present invention further comprises blocking the high pressure fluid from flowing through the distal end of the drill head, providing an annulus surrounding the drill head, and providing a spoonlike portion on each of the plurality of nozzle arms.

The preferred method of the invention further comprises the steps of providing each of the nozzle arms with a converging-diverging nozzle, extending at least one nozzle arm at a different angle from the remainder of the plurality of nozzle arms, and connecting the nozzle arms to the drill head with hinges.

The preferred method of the invention comprises the steps of providing the hinges with shear pins, and returning the nozzle arms to a position parallel to the longitudinal axis by gravity.

It is an object of the invention to provide high pressure drill head apparatus for circumferentially enlarging drill holes.

Another object of the invention is the provision of high pressure drill head apparatus with radially and horizontally extendable nozzle arms.

Still another object of the invention is the provision of a method for high pressure drilling.

Yet another object of the invention is the provision of nozzle arms pivotable and extendable by impingement thereon of hydraulic drilling fluid.

An advantage of the invention is the cheap and effective actuation of radially extendable nozzle arms by the action of drilling fluid alone.

Yet another advantage of the invention is the provision of nozzle arms hingedly connected to the drill body with shear pins.

still another advantage of the invention is the provision of nozzle arms retractable by the action of gravity alone.

Other objects, advantages, and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention.

DESCRIPTION OF THE PREFERRED EMBODIMENTS

Best Modes for Carrying Out the Invention

Figure 1:
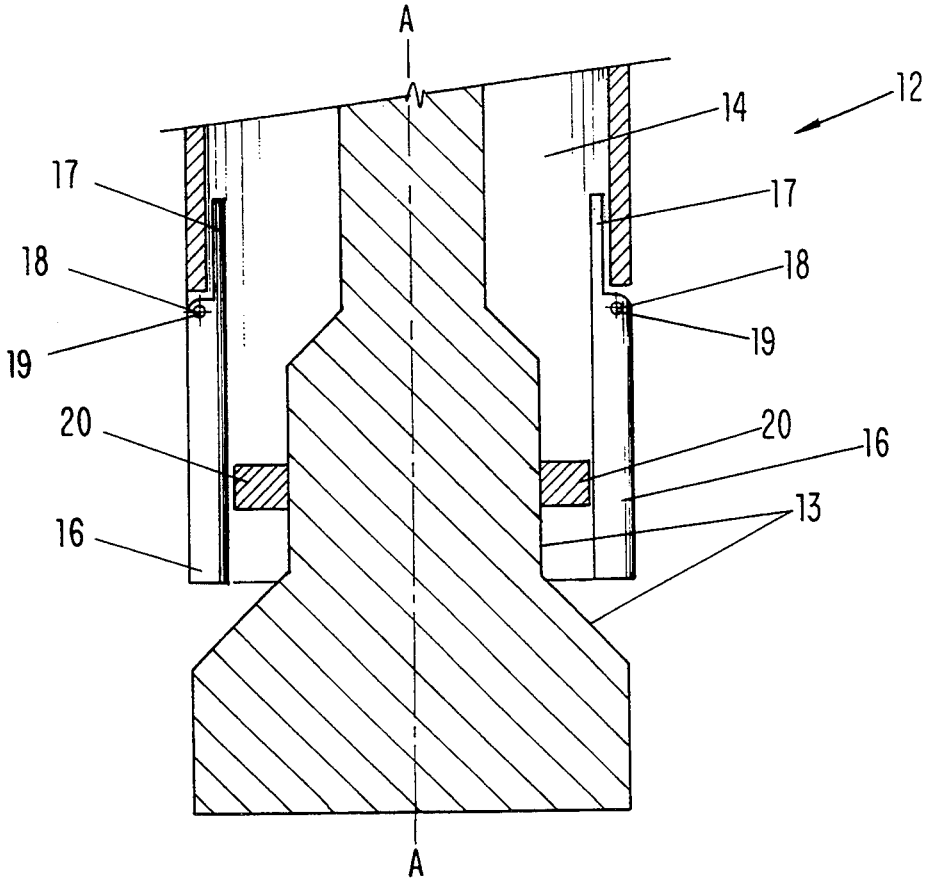
FIG. 1 is a cross-sectional view of the drilling head with arms retracted.
Figure 2:
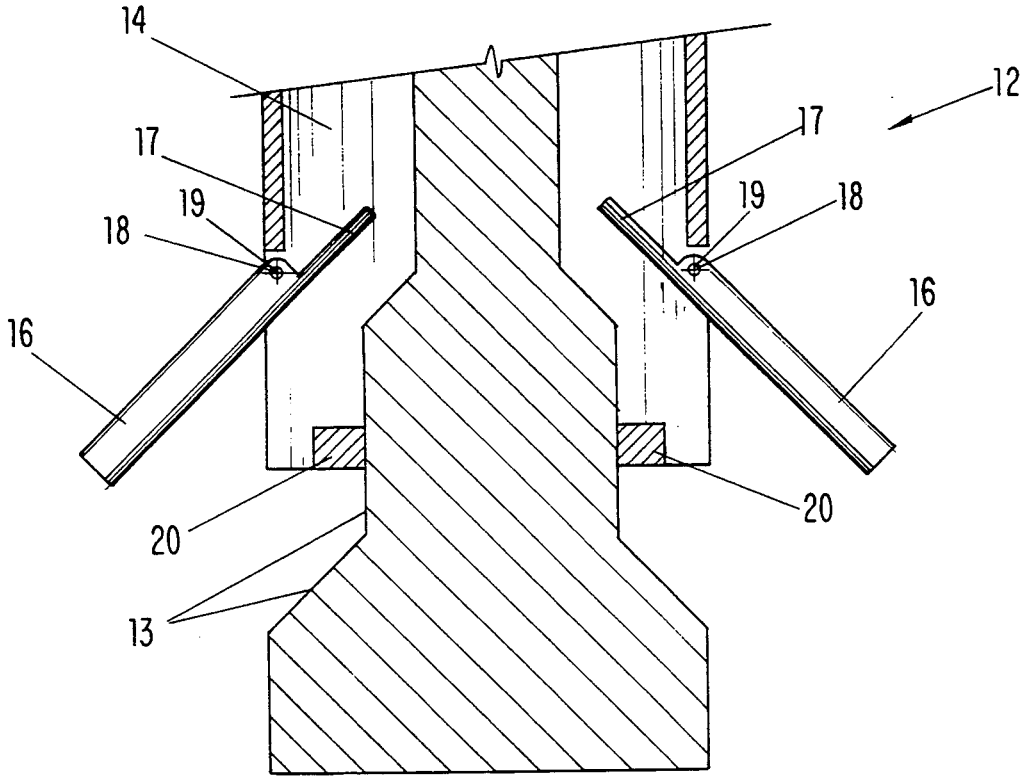
FIG. 2 is a cross-sectional view of the drilling head with arms partially extended.
Figure 3:
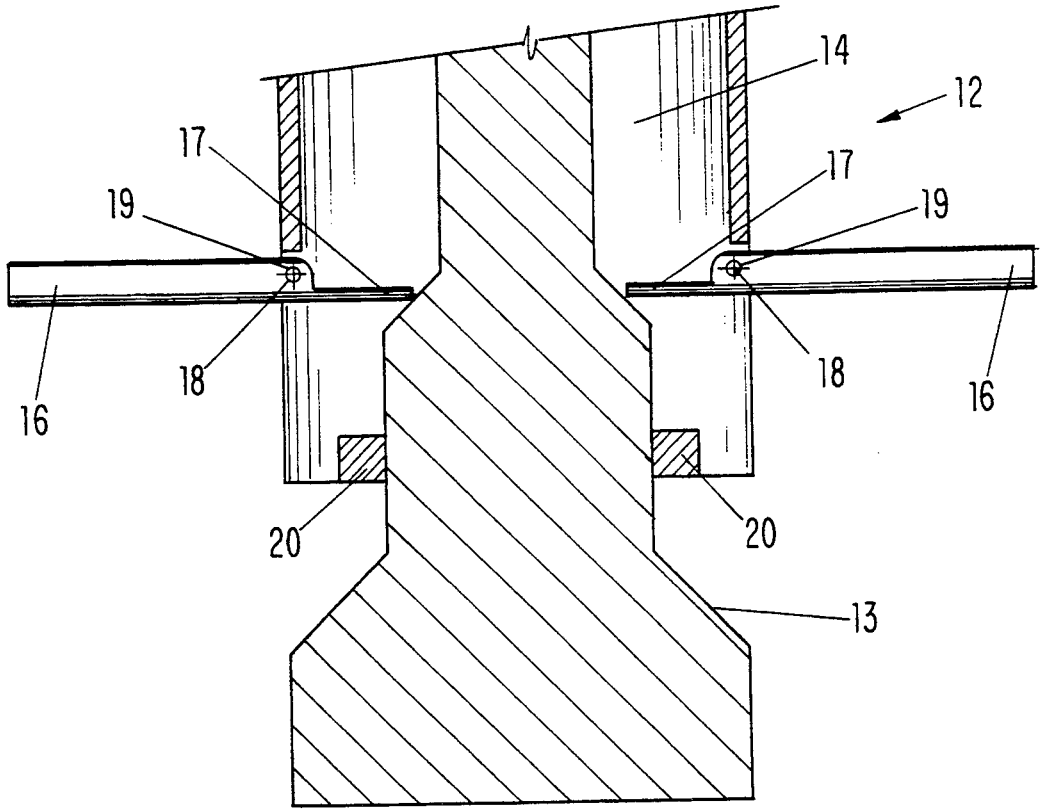
FIG. 3 is a cross-sectional view of the drilling head with arms fully extended.

Reference is now made to FIGS. 1–3, which show the preferred embodiment of the hydraulic drilling apparatus of the invention. Drilling apparatus comprises hydraulic drill head 12 connected to the usual drill string. Drill head 12 presents a generally cylindrical surface of revolution and is symmetrical about longitudinal axis A—A'. Beveled and reduced diameter portion 13 provides a nesting recess for nozzle arms 16 when inactive. Nozzle arms 16 extend vertically by force of gravity; the external surfaces of arms 16 then generally align with the external cylindrical surface of head 12. Drill head 12 is preferably solid at the distal end thereof.

Figure 5:
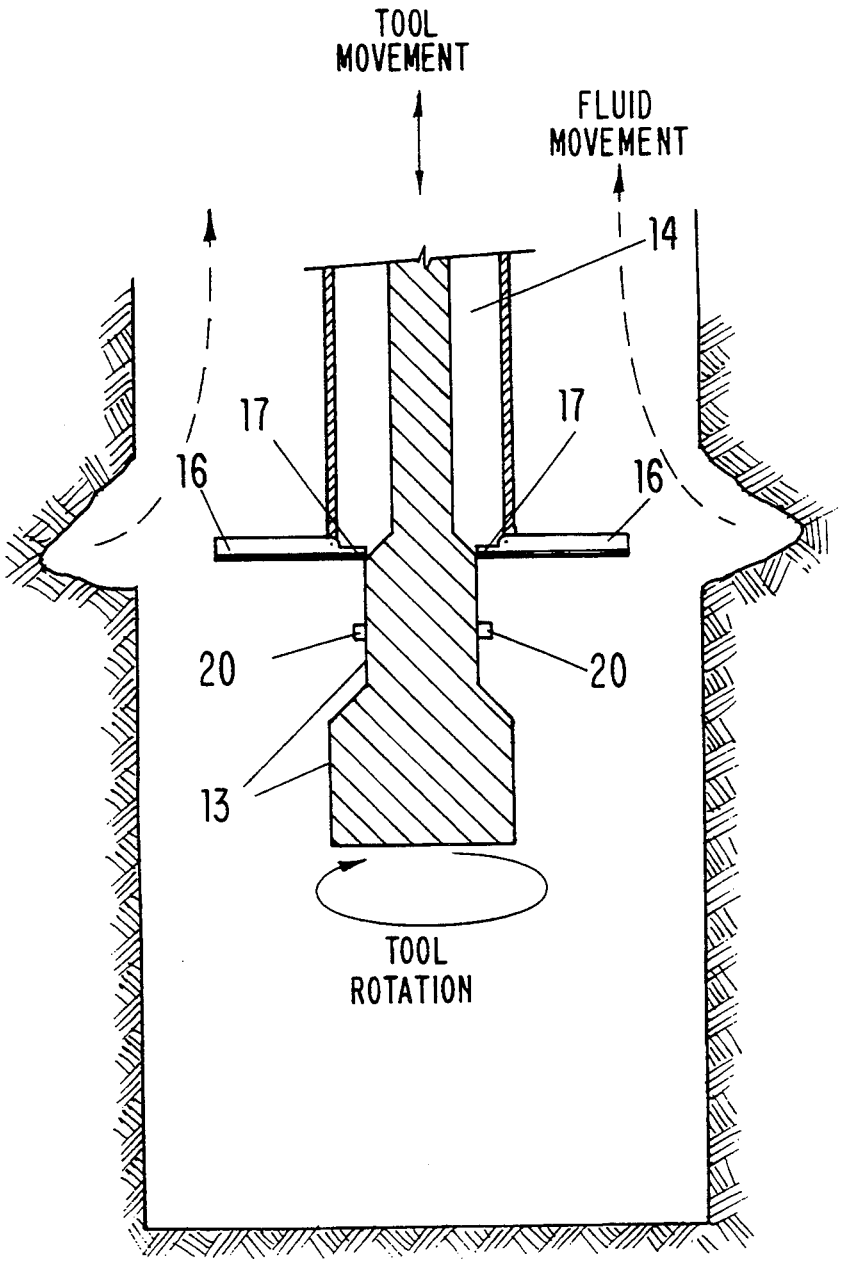
FIG. 5 is a cross-sectional view of the drilling head executing rotary and reciprocating motion.

As shown in FIG. 5, drill head 12 is also simultaneously rotated and reciprocated by a hydraulically driven drive nut or power swivel aboveground (not shown), such devices being well known in the drilling art. The drill head is slowly rotated and reciprocated at a rate of 4–6 revolutions and reciprocations per minute.

Drill head 12 further comprises channel 14 surrounding and on each side and concentric with longitudinal axis A—A' for passage of hydraulic drilling fluid therethrough. Such drilling fluid may comprise water, gases such as $N_2$ and $CO_2$, drilling mud, sand, air, and the like, as well as a combination of these substances. The particular drilling fluid used will primarily depend upon the rock encountered, and the desired rate of drilling.

Nozzle arms 16 are pivotably connected to drill head 12 by hinges 18. Hinges 18 are provided with shear pins 19 of malleable, easily fatigued metal, such as Babbitt metal, copper, tin, and the like. Thus, in the event of jamming, blocking, or stoppage of the drilling operation, arms 16 are readily separated from drill head 12, thereby permitting extrication and retraction of drill head 12 from the drill hole. Pins 19 should normally be able to withstand hydrostatic pressures of approximately 7,000 psi prior to shearing, however.

Hollow arms 16 further comprise nozzles at the ends thereof. Any suitable configuration, for example, convergent-divergent nozzles, is permissible; the main criterion for nozzle configuration is efficient conversion of high pressure fluid to high velocity fluid. Arms 16 are of half-cylindrical or spoonlike configuration at 17 above hinges 18.

Drill head 12 also comprises flow diverters 20. Diverters 20 are of any suitable configuration such that vertical downward fluid flow through channel 14 is diverted to radial flow against arms 16, thereby extending arms 16 radially and horizontally outward. The preferred configuration of diverter 20 is an annulus surrounding drill head 12.

Figure 4:
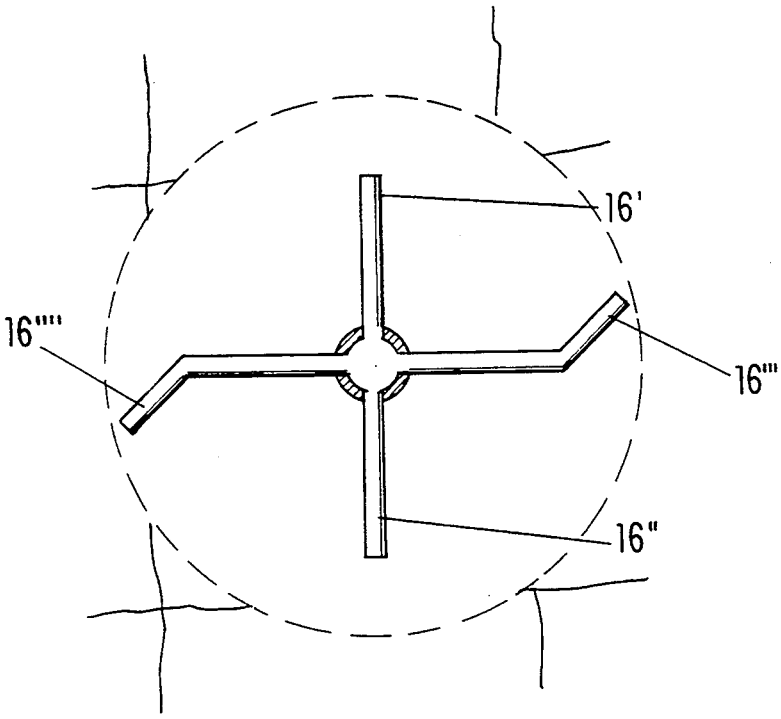
FIG. 4 is a top view of the drilling head showing the preferred configuration of the arms.

FIG. 4 illustrates the preferred embodiment of arms 16 when fully deployed. Arms 16' and 16'' extend linearly in a straight angle (180°) relative to each other. Arms 16''' and 16'''', however, are skewed or offset relative to a 180° configuration. This extended arm configuration provides an oblique as well as horizontal shearing capability.

Initially, downwardly flowing high pressure fluid (represented by arrows) is directed through channel 14 and impinges directly upon flow diverters 20 and is forced radially outwardly. Thereupon high pressure fluid forces arms 16 radially and horizontally outward, as depicted in FIG. 2. As arms 16 are extended radially, spoonlike arm portions 17 are thereby interposed directly into the flow path. Impingement of fluid upon spoonlike portion 17 provides further leverage, forcing arms 16 to their fully extended horizontal positions (see FIG. 3).

The drilling fluid, in addition to impinging upon arms 16 also flows through arms 16, being thereby converted to high velocity jets. As drill head 12 is rotated and reciprocated, these jets further fracture and shear naturally occurring faults, fractures, and laminations in the surrounding rock formation. This shearing process circumferentially enlarges the drill hole.

Cessation of flow through channel 14 returns arms 16 to recesses 13 by action of gravity alone.

Although the invention has been described with reference to these preferred embodiments, other embodiments can achieve the same results. Variations and modifications of the present invention will be obvious to those skilled in the art and it is intended to cover in the appended claims all such modifications and equivalents. The entire disclosures of all applications, patents, and publications cited above, and of the corresponding application are hereby incorporated by reference.

What is claimed is:

1. Hydraulic drilling apparatus comprising:

means comprising a drill head having a longitudinal axis;

means parallel to said longitudinal axis for channeling high pressure fluid through said drill head means; and annular means surrounding said drill head for diverting said high pressure fluid to and through a plurality of horizontally extendable nozzle arms, wherein said high pressure fluid horizontally extends said nozzle arms, and flows through said nozzle arms.

2. The apparatus of claim 1 whererin said drill head means further comprises means for blocking said high pressure fluid from flowing through the distal end of said drill head.

3. The apparatus of claim 1 wherein said high pressure fluid comprises a fluid selected from the group consisting of water, $N_2$, $CO_2$, drilling mud, sand, air, and mixtures thereof.

4. The apparatus of claim 1 wherein said means for diverting said high pressure fluid further comprises a spoonlike portion on each of said plurality of nozzle arms.

5. The apparatus of claim 1 wherein each of said plurality of nozzle arms further comprises converging-diverging nozzle means.

6. The apparatus of claim 1 wherein at least one of said plurality of nozzle arms extends at an angle different from the remainder of said plurality of nozzle arms.

7. The apparatus of claim 1 wherein each of said nozzle arms further comprises hinge means connecting said nozzle arms to said drill head means.

8. The apparatus of claim 7 wherein each of said hinge means further comprises shear pin means.

9. The apparatus of claim 1 wherein said plurality of nozzle arms are returned to a position parallel to said longitudinal axis by gravity.

10. A method of hydraulic drilling comprising the steps of:

a) providing a drill head having a longitudinal axis;

b) channeling high pressure fluid through a channel parallel to the longitudinal axis; and c) diverting, by providing an annulus surrounding the drill head, the high pressure fluid to and through a plurality of nozzle arms, thereby extending the plurality of nozzle arms.

11. The method of claim 10 wherein the step of providing a drill head further comprises the step of blocking high pressure fluid from flowing through the distal end of the drill head.

12. The method of claim 10 wherein the step of diverting high pressure fluid further comprises the step of providing a spoonlike portion on each of the plurality of nozzle arms.

13. The method of claim 10 wherein the step of diverting high pressure fluid further comprises the step of providing each of the plurality of nozzle arms with a converging-diverging nozzle,

14. The method of claim 10 wherein the step of diverting high pressure fluid further comprises the step of extending at least one nozzle arm at a different angle from the remainder of the plurality of nozzle arms,

15. The method of claim 10 wherein the step of diverting high pressure fluid further comprises the step of connecting the nozzle arms to the drill head with hinges.

16. The method of claim 15 wherein the step of connecting the nozzle arms to the drill head with hinges further comprises the step of providing the hinges with shear pins,

17. The method of claim 10 further comprising the step of returning the nozzle arms to a position parallel to the longitudinal axis by gravity.

* * * * *